US007491914B2

(12) United States Patent
Kim et al.

(10) Patent No.: US 7,491,914 B2
(45) Date of Patent: Feb. 17, 2009

(54) ELECTRIC OVEN

(75) Inventors: Wan Soo Kim, Gwangmyung-si (KR); Yong Woo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/616,991

(22) Filed: Dec. 28, 2006

(65) Prior Publication Data

US 2007/0145033 A1 Jun. 28, 2007

(30) Foreign Application Priority Data

Dec. 28, 2005 (KR) ..... 10-2005-0131106

(51) Int. Cl.
*A21B 1/26* (2006.01)

(52) U.S. Cl. ..... 219/400; 126/21 A; 99/474

(58) Field of Classification Search ..... None
See application file for complete search history.

(56) References Cited

U.S. PATENT DOCUMENTS 2,434,592 A * 1/1948 Schneider ..... 126/19 R
2,453,939 A * 11/1948 Schneider ..... 126/39 C
2,766,682 A * 10/1956 Smith ..... 99/419
3,603,241 A * 9/1971 Drucker ..... 99/335
3,633,491 A * 1/1972 Williams et al. ..... 99/340
4,114,523 A * 9/1978 Eff ..... 99/393
RE31,765 E * 12/1984 Guibert ..... 219/400
5,134,927 A * 8/1992 McCarthy et al. ..... 219/400
6,060,701 A * 5/2000 McKee et al. ..... 219/681
6,201,217 B1 * 3/2001 Moon et al. ..... 219/386
6,350,965 B2 * 2/2002 Fukushima et al. ..... 219/401
6,874,495 B2 * 4/2005 McFadden ..... 126/21 A
6,894,252 B2 * 5/2005 Paller et al. ..... 219/400
7,060,940 B2 * 6/2006 Kim et al. ..... 219/400
7,126,097 B2 10/2006 Kim et al.
2005/0133019 A1 6/2005 Kim et al.

FOREIGN PATENT DOCUMENTS

GB 1414869 A 11/1975

OTHER PUBLICATIONS

U.S. Appl. No. 11/613,506, filed Dec. 20, 2006, Kim et al.
U.S. Appl. No. 11/416,327, filed May 3, 2006, Lee et al.
U.S. Appl. No. 11/412,787, filed Apr. 28, 2006, Kim et al.
U.S. Appl. No. 11/412,785, filed Apr. 28, 2006, Lee et al.
U.S. Appl. No. 11/392,755, filed Mar. 30, 2006, Nam et al.
U.S. Appl. No. 11/392,751, filed Mar. 30, 2006, Nam et al.
U.S. Appl. No. 11/673,776, filed Dec. 12, 2006, Lee et al.

* cited by examiner

*Primary Examiner*—Joseph M Pelham
(74) *Attorney, Agent, or Firm*—Greenblum & Bernstein, P.L.C.

(57) ABSTRACT

An electric oven is provided. The electric oven includes a chamber, a heater that heats air in the chamber and a flow guide defining a cooking space for food therein. The flow guide uniformly transfers heated air in the chamber to the food in the cooking space. The flow guide includes a body for covering the food and an exhaust for exhausting air that flows into the body.

20 Claims, 5 Drawing Sheets

ELECTRIC OVEN

This application claims the benefit of the Patent Korean Application No. 10-2005-0131106, filed on Dec. 28, 2005, which is hereby incorporated by reference in its entirety.

BACKGROUND OF THE INVENTION

1. Field of the Invention

The present invention relates to an electric oven, and more particularly, to an electric oven that evenly sustains the flow of air around a food item being cooked through convection to obtain favorable cooking results in a short time.

2. Description of the Related Art

Generally, an electric oven is a cooking appliance that has a heat source provided in a chamber generating heat to cook food. Electric ovens can generally be divided into countertop ovens and built-in ovens.

Specifically, countertop electric ovens are independently placed on kitchen counters, etc., and built-in electric ovens have their chamber portions built into kitchen walls or kitchen cabinets.

An electric oven according to the related art includes a chamber forming a cooking space, a rack provided within the chamber for supporting food to be cooked therein, a heater for heating the food to be cooked that is placed on the rack, and a door for selectively opening and closing the cooking space.

In detail, the heater includes an upper heater located at the top of the chamber, a lower heater located at the bottom of the chamber, and a convection heater located at the rear of the chamber. The convection heater has an adjacent fan that circulates heat generated by the convection heater within the chamber. The rack allows food to be put in and taken out of the chamber.

Methods for altering the structure of the rack in order to achieve better cooking result have been proposed. Specifically, one method proposes that a heater be installed below the rack to raise the effectiveness of heating the food, and another method proposes using a member made of a highly thermal conductive metal or other material below the rack to maintain uniformity in the heat rising up to the rack.

Despite there being a variety of such proposals, the problem of being unable to create a uniform flow of heat within the expansive chamber still exists, impeding the attainment of favorable cooking results.

When heat flows quickly and contacts certain parts of food to be cooked, the food is heated unevenly. Also, in the case of multi-level cooking, the cooking of food differs according to the position of the rack on which it is placed.

SUMMARY OF THE INVENTION

Accordingly, the present invention is directed to an electric oven that substantially obviates one or more problems due to limitations and disadvantages of the related art.

An object of the present invention is to provide an electric oven capable of evenly transferring heat generated from a heater to food to be cooked.

Another object of the present invention is to provide an electric oven capable of making the cooking speed of food and the heating pattern of the food uniform by providing a flow guide for uniformly guiding heat around the food, so that the flow of heat within the flow guide is uniformly maintained.

Additional advantages, objects, and features of the invention will be set forth in part in the description which follows and in part will become apparent to those having ordinary skill in the art upon examination of the following or may be learned from practice of the invention According to one aspect of the invention, there is provided an electric oven including a chamber; a heater that heats air in the chamber; and a flow guide defining a cooking space for food therein, the flow guide uniformly transferring heated air in the chamber to the food in the cooking space.

A portion of air within the chamber may flow along an inside of the flow guide. The flow guide may include a body for covering the food; and an exhaust for exhausting air that flows into the body. The air that is exhausted through the exhaust may move toward the heater. The heater may be disposed on one side of the chamber.

The body may include a plurality of intake holes formed therein, for allowing air within the chamber to flow into the body. The plurality of intake holes may be formed along a periphery of the body. The intake holes may be provided with guide vanes for guiding an intake of heated air. The exhaust may be movable relative to the body. The body may be formed of a transparent or semitransparent material. The body may have a substantially domed shape. The flow guide may be positioned over food located on a rack positioned in the chamber.

According to another aspect of the invention, an electric oven includes a chamber; a flow guide for covering at least a portion of food positioned in the chamber; a convection heater that heats air in the chamber; and a convection fan for circulating air inside the chamber, wherein air heated by the convection heater flows inside the flow guide through a plurality of intake holes and uniformly heats the food.

The intake holes may be formed at regular intervals around a perimeter of the flow guide. The air flowing into the flow guide may be exhausted toward the convection heater. A direction of air that is exhausted from the flow guide may be adjustable.

The flow guide may include a body for covering the food; and an exhaust for exhausting air that flows into the body. The exhaust may include at least one bellows portion for allowing the exhaust to bend. The intake holes may be formed at a lower end of the body.

According to another aspect of the invention, an electric oven includes a chamber defining a first space therein; a flow guide defining a second space within the first space; and a plurality of intake holes formed in the flow guide, for communicating the first space with the second space, wherein heated air in the first space is transferred to food positioned in the second space through the intake holes for evenly heating the food.

The electric oven according to the present invention uniformly transfers heat to food through the flow guide, allowing for even heating of the food.

In the case of meats that normally take a long time to cook, the flow of heat can be concentrated around the cooking object, reducing the cooking time and allowing for speed cooking.

Also, the flow guide helps reduce contamination of the chamber, to increase convenience in cleaning the chamber. That is, impurities that are generated during cooking mostly adhere to the inner surface of the flow guide, so that only the flow guide may be taken out and cleaned, increasing user convenience.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. Wherever possible, the same reference numbers will be used throughout the drawings to refer to the same or like parts.

Figure 1:
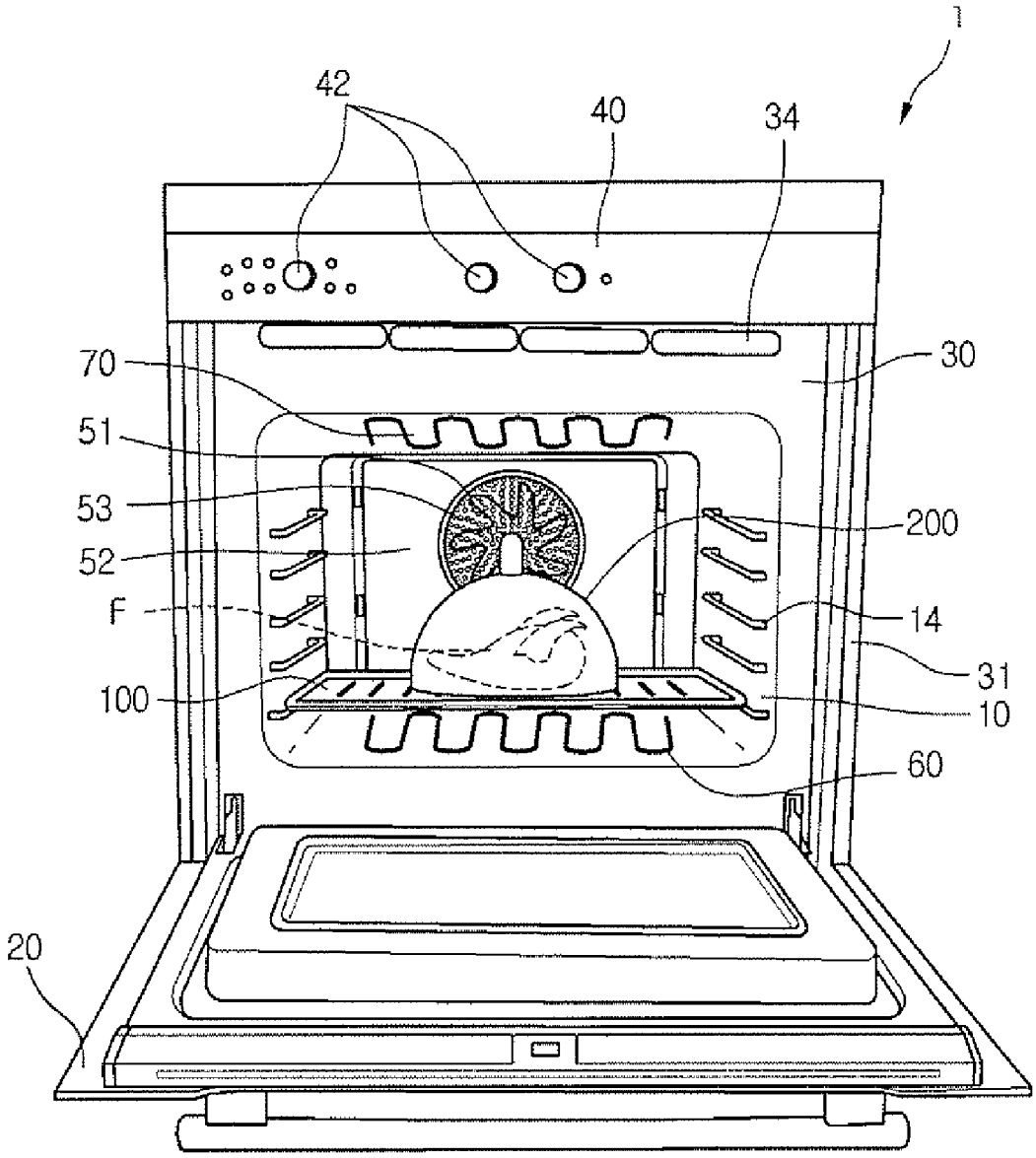
FIG. 1 is a front view of an electric oven according to the present invention.

FIG. 1 is a front view of an electric oven according to the present invention. Referring to FIG. 1, an electric oven 1 according to the present invention includes a chamber 10 forming a cooking compartment in which food F is placed, a door 20 for selectively opening and closing the inner space of the chamber 10, and a flow guide 200 for allowing uniform heating of the food F.

In detail, a front plate 30 is provided at the front of the chamber 10 to form the outer front portion of the chamber 10, and a side trim 31 is provided to the left and right sides of the front plate 30.

That is, the side trim 31 protrudes forward from the front plate 30, to contact the rear surface of the door 20 when the door 20 is closed and prevent air from leaking.

Also, exhaust ports 34 are provided at the top of the front plate 30 to exhaust air from a machine room to the outside. Also, a control panel 40 for controlling the operation of the electric oven 1 is installed above the exhaust ports 34, and has controls 42 thereon.

A lower heater 60 for heating the food F from below is provided at the bottom of the chamber 10, and an upper heater 70 for heating the food F from above is provided at the top of the chamber 10. Furthermore, a convection fan 51 connected to and rotating with a motor, and a heater 50 (in FIG. 4) are provided at the rear of the chamber 10.

The convention fan 51 circulates heat generated from the heater 50 (in FIG. 4) into the chamber 10 to evenly cook the food.

Also, a protective cover 52 for protecting the convection fan 51 and the convection heater 50 is provided in front of the convection fan 51. A plurality of through-holes 53 are formed in the central portion of the protective cover 52, for allowing heat generated by the convection heater 50 to pass into the chamber 10.

The protective cover 52 ensures that when the convection fan 51 is operating, a user will not get burned, and also provides even distribution of air flow generated by the convection fan 51.

A plurality of rails 14 for supporting a rack 100 on which food is placed is provided vertically on either inner side wall of the chamber 10. Here, in order to respectively position a variety of food F types for optimum cooking, the rails 14 may be provided at regular intervals in pairs along both inner side walls of the chamber 10.

The flow guide 200 performs the function of guiding the air inside the chamber 10 so that it is evenly transferred to the food F. Also, the flow guide 200 encloses the food F, and may be put in and taken out of the chamber 10 while placed on the rack 100.

Below structure of the flow guide 200 will be described in detail.

Figure 2:
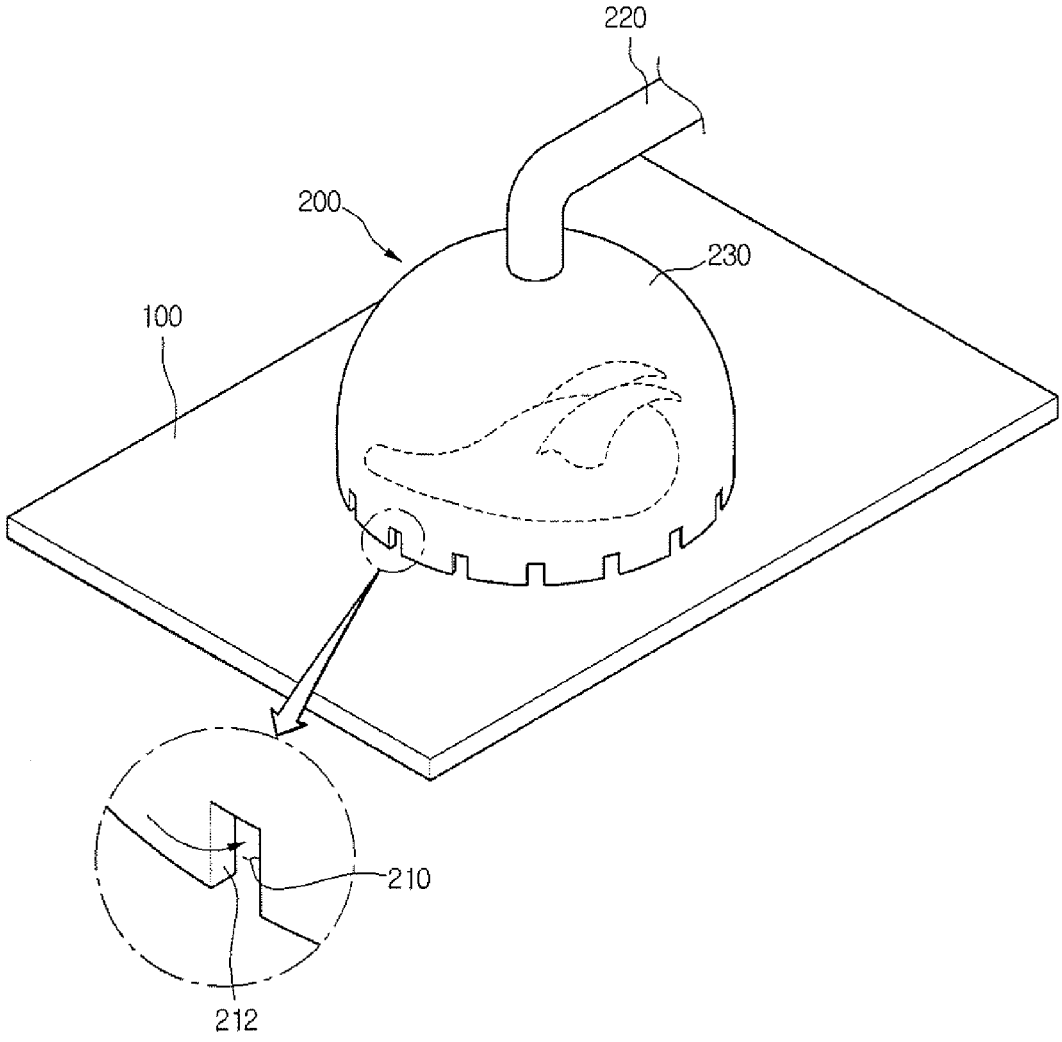
FIG. 2 is a perspective view of a flow guide according to the present invention.

FIG. 2 is a perspective view of a flow guide according to the present invention.

Referring to FIG. 2, a flow guide 200 according to the present invention includes a dome-shaped body 230, a plurality of intake holes 210 formed in the body 230 for allowing air inside the chamber 10 to enter the inside of the body 230, and an exhaust 220 provided at the top of the body 230 and providing a passage for the air entering the body 230 to be exhausted outside.

In more detail, the body 230 has a roughly hemispherical shape, and is placed on the rack 100 to enclose the food F. Here, the body 230 may be formed of a material having a high thermal conductivity, and may be formed of a transparent or semitransparent material to enable the food cooking inside to be checked visually.

The intake holes 210 are formed in the lower portion of the body 230 at a predetermined interval around the circumference of the body 230.

Here, the intake holes 210 may be formed by cutting portions of the body 230, and may be bent with one side connected to the body 230 to form guide vanes 212 for guiding the inflow of air.

The guide vanes 212 may be bent inward or outward from the body 230, in order to more evenly guide air within the body 230. In the embodiment shown in FIG. 2, the guide vane 212 is bent inward.

The intake hole 210 may be evenly formed at the bottom of the body 230 at regular intervals, or may be formed at irregular intervals if needed.

The exhaust 220 is provided as a passage for exhausting air that has been used to cook food F. The exhaust 220, in order to optimally exhaust the air, may have an end thereof pressed against the protective cover 52 (especially at the region where the central portion of the convection fan 51 is).

The exhaust 220 may have one end thereof formed with an expanded diameter, for easily exhausting the air from inside the body 230.

Figure 3:
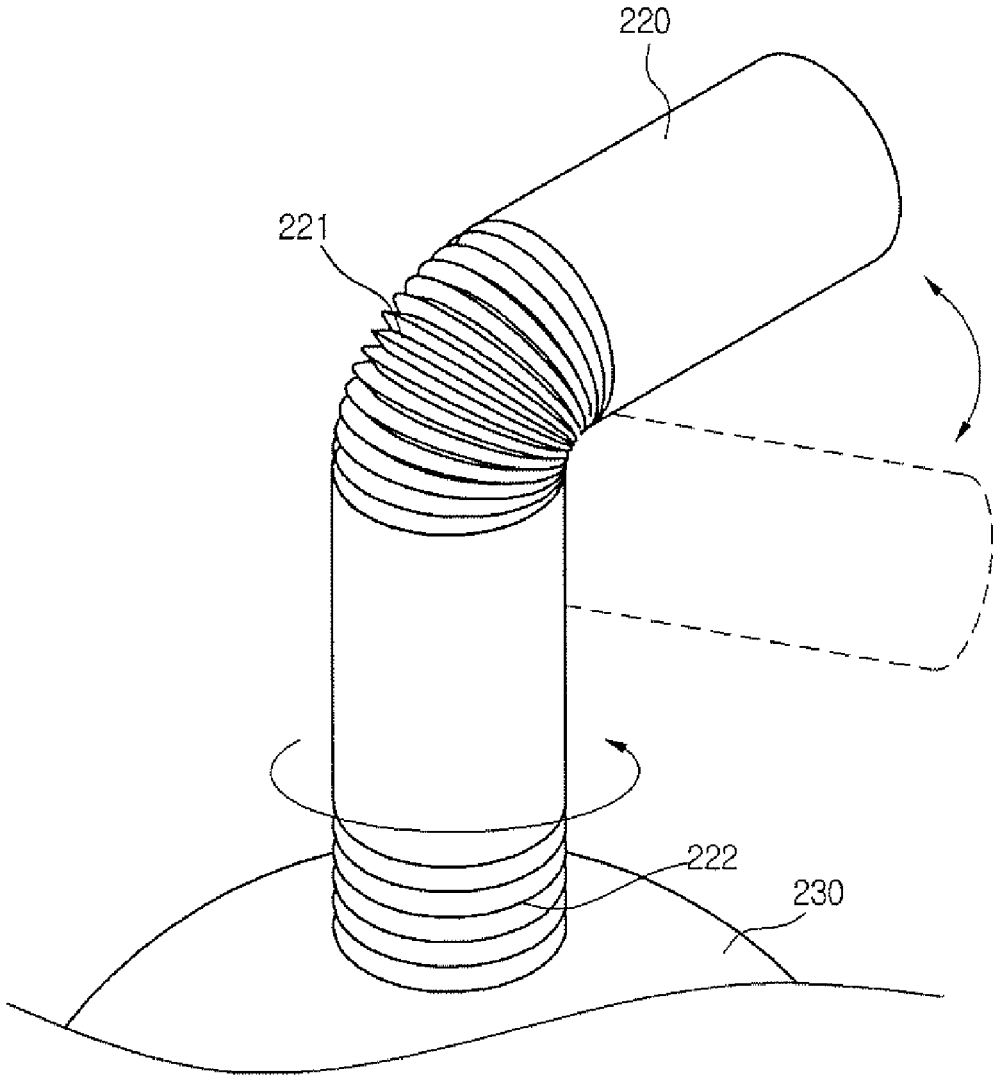
FIG. 3 is a perspective view of an exhaust of a flow guide according to an embodiment of the present invention.

FIG. 3 is a perspective view of an exhaust of a flow guide according to an embodiment of the present invention.

Referring to FIG. 3, the exhaust 220 of the flow guide according to the present embodiment has the characteristic of being able to move freely with respect to the body 230.

Specifically, the exhaust 220 includes a first bellows portion 221 and a second bellows portion 222, for enabling the direction of air exhausted from the inside of the body 230 to be adjusted. The second bellows portion 222 may be formed at the connecting portion between the body 230 and the exhaust 220.

The bellows portions 221 and 222 may be formed of the same material as the exhaust 220, or may be formed separately of a rubber or plastic material with a high degree of elasticity.

Figure 4:
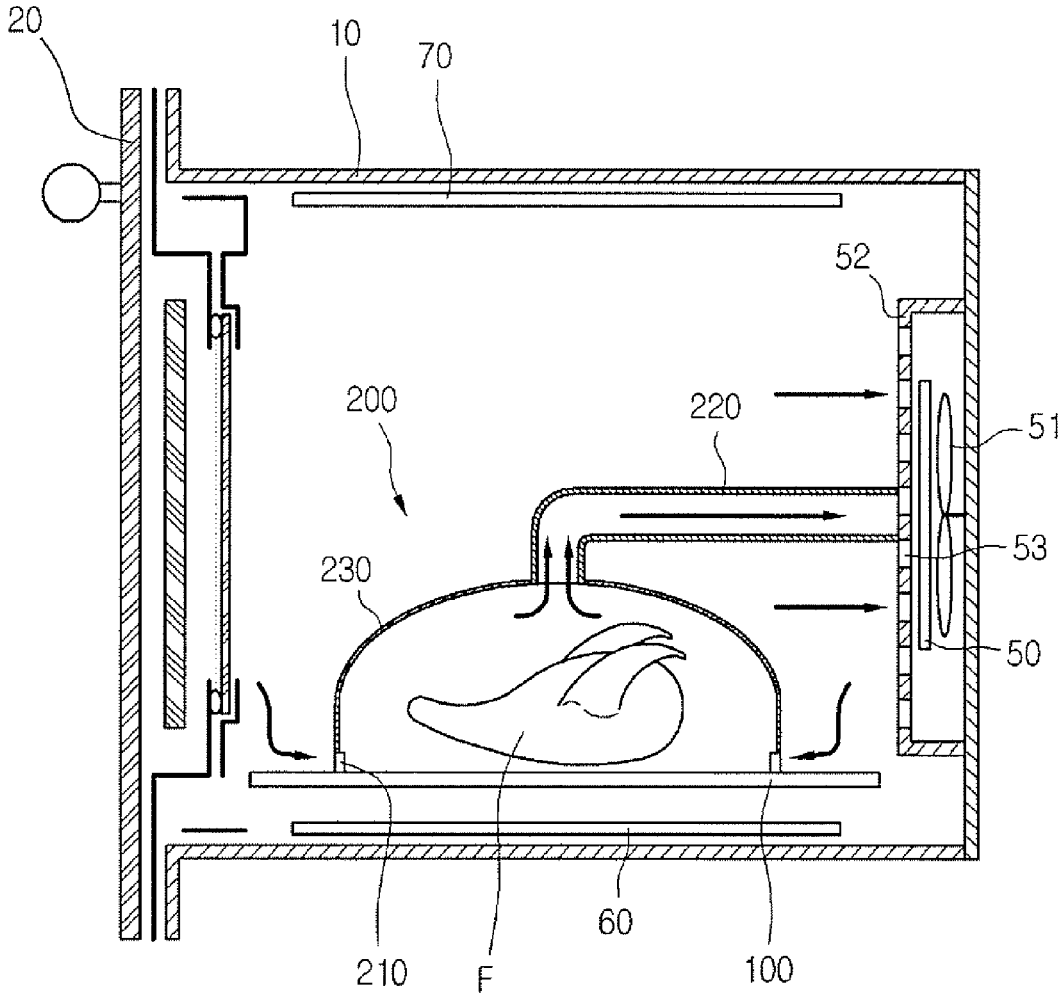
FIG. 4 is a sectional view of an electric oven according to the present invention.
Figure 5:
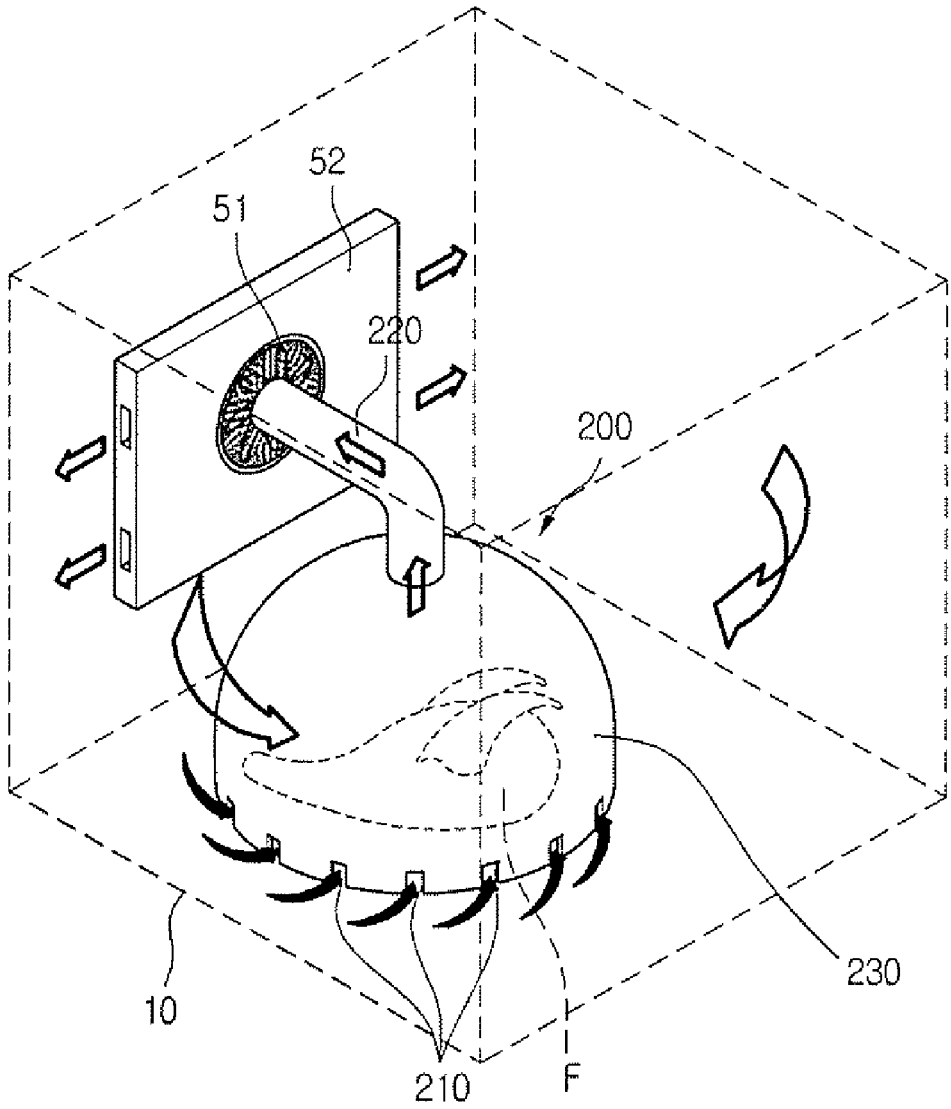
FIG. 5 is a perspective view showing the operation of the electric oven according to the present invention.

FIG. 4 is a sectional view of an electric oven according to the present invention, and FIG. 5 is a perspective view showing the operation of the electric oven according to the present invention.

Referring to FIGS. 4 and 5, a user opens the door 20 and places food F to be cooked on the rack 100. Then, the food F is covered with the flow guide 200. Next, the rack 100 on which the food F is placed is inserted into the chamber 10, and the door 20 is shut to begin the cooking process.

Then, the upper heater 70 provided at the top of the chamber 10, the lower heater 60 provided at the bottom of the chamber 10, and the convection heater 50 provided at the rear of the chamber 10 alternately or simultaneously operate to perform cooking. Also, the heaters heat air, which enters through the intake holes 210 to be supplied to the inside of the body 230. The air that enters the body 230 heats the food F and is exhausted through the exhaust 220 towards the convection fan 51.

When this process is continuously repeated, the cooking of the food is completed.

By means of the confined space for cooking formed by the body 230, the food F is cooked in a focused manner. Accordingly, electrical energy consumption is reduced, and the overall cooking time is also reduced.

Additionally, because air from inside the chamber 10 uniformly flows into the body 230, the food F can be more evenly heated.

Moreover, impurities generated from food F during cooking thereof adhere to the inside of the flow guide 200, so that after the cooking is completed, the flow guide 200 can be taken out from the chamber 10 and cleaned, to allow a user to easily perform cleaning.

The above application of the flow guide may be especially useful when cooking meats that generate fatty deposits.

It will be apparent to those skilled in the art that various modifications and variations can be made in the present invention. Thus, it is intended that the present invention covers such modifications and variations of the invention.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to exemplary embodiments, it is understood that the words that have been used are words of description and illustration, rather than words of limitation. As the present invention may be embodied in several forms without departing from the spirit or essential characteristics thereof, it should also be understood that the above-described embodiment is not limited by any of the details of the foregoing description, unless otherwise specified. Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. An electric oven comprising:

a chamber;

a rack mounted on an inner side wall of the chamber, the rack configured to receive food placed thereon;

a heater that heats air in the chamber; and a flow guide configured to be selectively seated on an upper surface of the rack and covering the food placed on the rack, and defining a cooking space for the food therein, the flow guide uniformly transferring heated air in the chamber to the food in the cooking space, and wherein the flow guide includes an exhaust portion, at an upper portion of the flow guide, to convey the heated air away from the cooking space.

2. The electric oven according to claim 1, wherein a portion of air within the chamber flows along an inside of the flow guide.

3. The electric oven according to claim 1, wherein the flow guide comprises:

a body for covering the food; and an exhaust extending from the body to exhaust air that flows into the body.

4. The electric oven according to claim 3, wherein the air that is exhausted through the exhaust moves toward the heater.

5. The electric oven according to claim 4, wherein the heater is disposed on one side of the chamber.

6. The electric oven according to claim 3, wherein the body comprises a plurality of intake holes formed therein, the plurality of intake holes allowing air within the chamber to flow into the body.

7. The electric oven according to claim 6, wherein the plurality of intake holes are formed along a periphery of the body.

8. The electric oven according to claim 6, wherein the intake holes are provided with guide vanes to guide an intake of heated air.

9. The electric oven according to claim 3, wherein the exhaust is movable relative to the body.

10. The electric oven according to claim 3, wherein the body is formed of a transparent or semitransparent material.

11. The electric oven according to claim 3, wherein the body has a substantially domed shape.

12. The electric oven according to claim 1, wherein the flow guide is readily removable from the chamber to allow a user to easily perform cleaning.

13. An electric oven comprising:

a chamber;

a rack mounted on an inner side wall of the chamber, the rack configured to receive food placed thereon;

a flow guide configured to be seated on the rack and covering at least a portion of the food positioned on the rack, the flow guide having an exhaust portion at an upper portion thereof;

a convection heater that heats air in the chamber; and a convection fan that circulates air inside the chamber, wherein air heated by the convection heater flows inside the flow guide through a plurality of intake holes and out through the exhaust portion to uniformly heat the food.

14. The electric oven according to claim 13, wherein the intake holes are formed at regular intervals around a perimeter of the flow guide.

15. The electric oven according to claim 13, wherein air flowing into the flow guide is exhausted toward the convection heater.

16. The electric oven according to claim 15, wherein a direction of air that is exhausted from the flow guide is adjustable.

17. The electric oven according to claim 13, wherein the flow guide comprises:

a body configured to cover the food; and an exhaust extending from an outer side of the body to exhaust air that flows into the body.

18. The electric oven according to claim 17, wherein the exhaust comprises at least one bellows portion that allows the exhaust to bend.

19. The electric oven according to claim 17, wherein the intake holes are formed at a lower end of the body.

20. An electric oven comprising:

a chamber defining a first space therein;

a flow guide defining a second space within the first space, the flow guide having an exhaust portion at an upper portion thereof;

a support that supports the flow guide and food, the support configured to be selectively mounted on an inner side wall of the chamber, the food being located in the first space; and a plurality of intake holes formed in the flow guide, the plurality of intake holes communicating the first space with the second space, wherein heated air in the first space is transferred to food positioned in the second space through the intake holes and out through the exhaust portion to evenly heat the food, wherein the support can be taken out of the chamber with the flow guide.

* * * * *